US006357965B2

(12) United States Patent
Lammertink et al.

(10) Patent No.: US 6,357,965 B2
(45) Date of Patent: Mar. 19, 2002

(54) METHOD, SYSTEM AND DEVICE FOR BUILDING A WALL IN THE GROUND

(75) Inventors: Marinus Chr. Lammertink, Beverwijk; Rutger Chr. van Voorden, Zwijndrecht; René Broeder, Culemborg, all of (NL)

(73) Assignee: Heerema Ondergrondse Infrastructuren B.V., Rotterdam (NL)

( * ) Notice: Subject to any disclaimer, the term of this patent is extended or adjusted under 35 U.S.C. 154(b) by 0 days.

(21) Appl. No.: 09/113,017

(22) Filed: Jul. 6, 1998

(30) Foreign Application Priority Data

Jul. 11, 1997 (EP) ..... 97202177

(51) Int. Cl.[7] ..... E21B 7/26

(52) U.S. Cl. ..... 405/138; 405/150.2; 175/62; 175/171

(58) Field of Search ..... 405/132, 138, 405/150.1, 150.2; 175/22, 53, 62, 171

(56) References Cited

U.S. PATENT DOCUMENTS

| | | | | | |
|---|---|---|---|---|---|
| 2,096,850 | A | * | 10/1937 | Forsberg | 405/150.1 |
| 3,325,217 | A | * | 6/1967 | Enz | 175/52 X |
| 3,482,641 | A | * | 12/1969 | Atkins et al. | 175/62 X |
| 3,656,563 | A | * | 4/1972 | Blinne | 175/22 |
| 3,874,463 | A | | 4/1975 | Hicks et al. | 175/53 |
| 3,894,402 | A | | 7/1975 | Cherrington | 405/184 |
| 4,043,136 | A | * | 8/1977 | Cherrington | 175/53 X |
| 4,146,347 | A | * | 3/1979 | Woods | 405/184 |
| 4,148,193 | A | * | 4/1979 | Mottes | 405/155 |
| 4,456,078 | A | | 6/1984 | Adam | 175/20 |
| 4,673,312 | A | * | 6/1987 | Nussbaumer | 405/184 |
| 4,892,441 | A | | 1/1990 | Riker | 405/146 |
| 5,505,558 | A | | 4/1996 | Brown | 405/184 |
| 5,813,482 | A | * | 9/1998 | Barbera | 175/171 X |
| 5,928,447 | A | * | 7/1999 | GianFrancisco | 405/150.1 |

FOREIGN PATENT DOCUMENTS

| | | | |
|---|---|---|---|
| DE | A-O 354 335 | 6/1989 | |
| DE | A-O 483 445 | 10/1990 | |
| EP | 0 336 331 A1 | 4/1989 | E21D/11/10 |
| EP | 0 411 278 A1 | 6/1990 | E21B/7/28 |
| EP | 0 557 805 A1 | 2/1993 | E21D/9/10 |
| FR | 91 19021 | 7/1997 | E21C/25/22 |

OTHER PUBLICATIONS

Publication: Handbook of Mining and Tunnel Machinery, pp. 415–417, No Date.
Publication: Tunnels & Tunneling, p. 15, No Date.
European Patent Office Patent Abstracts of Japan Publication No. 03288080; publication date Dec. 18, 1991 Applicant Mitsubishi Heavy Ind LTD.

* cited by examiner

*Primary Examiner*—Thomas B. Will
*Assistant Examiner*—Tara L. Mayo
(74) *Attorney, Agent, or Firm*—Oblon, Spivak, McClelland, Maier & Neustadt, P.C.

(57) ABSTRACT

A wall is built in the ground by pulling a wall building device having cross-sectional dimensions which are substantially equal to the dimensions of at least a part of the cross-section of the wall through the ground, at least a part of the wall being formed by injecting a hardenable material behind the wall building device. A tunnel is made by first making a tunnel wall, leaving the ground inside the tunnel wall substantially intact, followed by excavating the ground inside the tunnel wall.

95 Claims, 11 Drawing Sheets

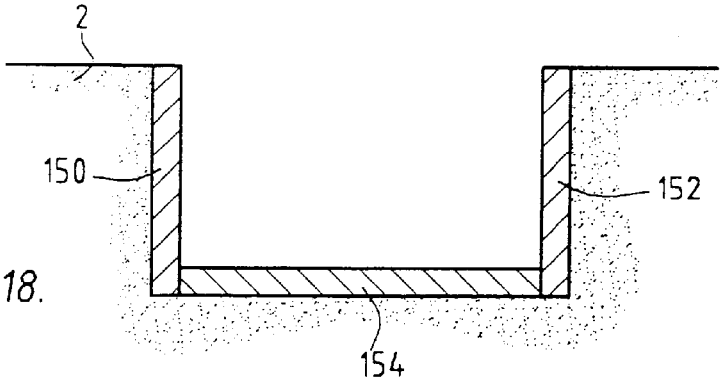
FIG. 18.
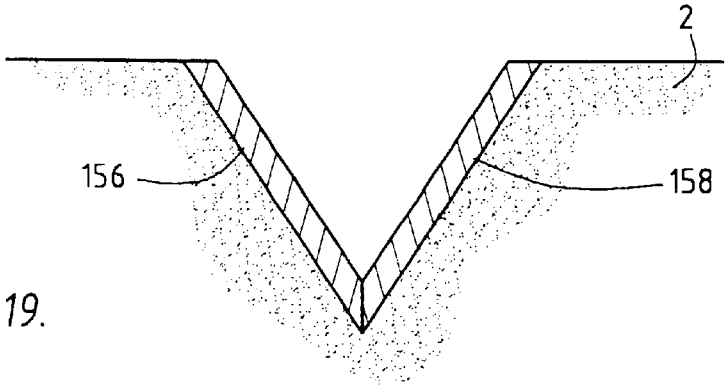
FIG. 19.
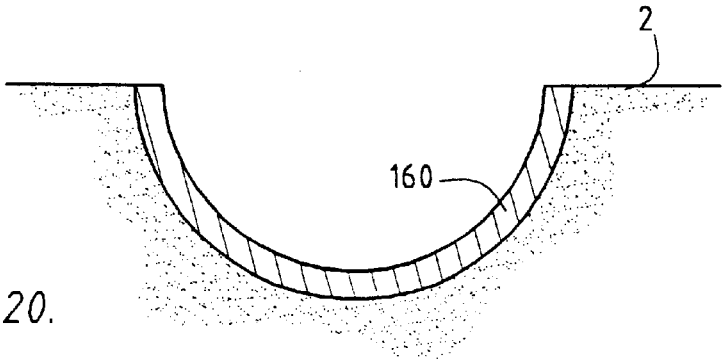
FIG. 20.
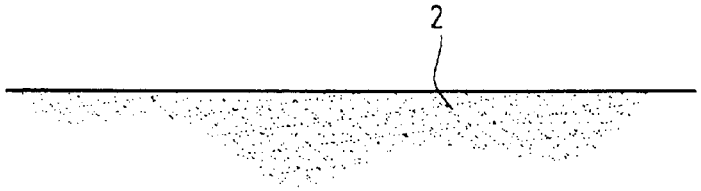
FIG. 21.
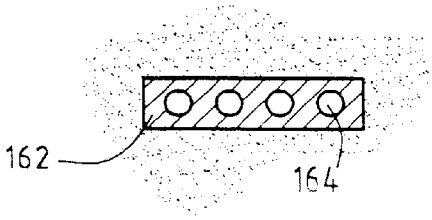

METHOD, SYSTEM AND DEVICE FOR BUILDING A WALL IN THE GROUND

BACKGROUND OF THE INVENTION

This invention relates to a method for building a wall or a part thereof in the ground, a system for carrying out the method, and a wall building device for use in the method and system.

DISCUSSION OF THE PRIOR ART

Known tunnel wall building devices are e.g. described in the "Handbook of Mining and Tunnel Machinery", Barbara Stack, 1982, published by John Wiley and Sons, pages 415–417. These known tunnel wall building devices comprise a cutting face at the front of a cylindrical shield. The tunnel wall building device is pushed in the direction of the advance of the shield by hydraulic cylinders acting between the rear side of the shield and the constructed tunnel wall.

A first drawback of the use of such tunnel wall building devices is the criticality of the control over the stabilization of the ground in front of the cutting face. Too much excavation will cause local collapse of the ground, while too great a push force will cause undesirable settlements of the ground.

A second drawback is the required axial support of the tunnel wall building device on the tunnel wall. In case of the use of prefabricated elements the axial support force might be a governing load case.

In other methods the tunnel wall is made of extruded concrete. In this respect reference is made here to EP-A-0 354 335 describing axially supporting a boring shield by the extruded concrete tunnel wall through formwork elements used for forming the inner side of the tunnel wall. The tunnel wall building method according to this publication is discontinuous, taking away formwork elements where the concrete has hardened, and adding the formwork elements, after cleaning thereof, directly behind the boring shield. This method is expensive and time-consuming as a result of the use of the formwork elements, which need to be handled behind the boring shield, and can only be removed when the concrete they are supporting has hardened sufficiently, which may take considerable time.

EP-A-0 483 445 describes a continuous tunnel wall building method, extruding concrete to form a tunnel wall, and using a sliding formwork arrangement requiring additional means to transfer the axial boring forces to the hardened part of the tunnel wall and to facilitate continuity.

In all previous methods the management of the ground water level during the fabrication of the tunnel wall may present serious problems.

SUMMARY OF THE INVENTION

The object of the present invention is to provide a method, system, and device for building a wall or a part thereof in general, and a tunnel wall in particular which avoid the risk of collapse or undesirable settlement of the ground in front of the wall building area.

Another object of the present invention is to provide a wall building method, system, and device which do not rely on the wall for providing an axial support for the wall building activities.

Yet another object of the present invention is to provide a wall building method, system, and device which can be continuous and do not use formwork elements.

A further object of the present invention is to provide a wall building method, system, and device which are virtually unaffected by the ground water level.

To reach the above objects, in the method according to the invention a wall building device having cross-sectional dimensions which are substantially equal to the dimensions of at least a part of the cross-section of the wall is pulled through the ground, at least a part of the wall being formed by injecting a hardenable material behind the wall building device. In the process of making the wall, the wall is supported on all sides by the ground surrounding the wall (and, in the case of a tunnel wall, by the ground filling the tunnel wall). Consequently, the wall requires no direct strength, and can e.g. be made from fiber concrete with a normal hardening time. The excavation of the ground at one side of the wall can be done after the completion of the tunnel wall, and the stability of the excavation presents no problem at all. Different shapes of wall cross-sections are possible, but not limited to: (semi-)circular, elliptical, rectangular, triangular, flat. Since the wall building device is advanced by pulling, no reaction force is applied on the constructed wall. The advance of the wall building device is therefore independent from the structural strength of the wall at any given moment.

In a preferred embodiment of the wall building method according to the invention, the following steps are performed: drilling one or more holes in the ground, on or parallel to the projected path of the wall, each of the one or more holes being drilled by means of a drill string; connecting one end of each drill string at the end of the drilling operation to the wall building device; and pulling the wall building device through the ground by retracting the one or more drill strings. Alternatively, the wall building method may comprise the steps of: drilling one or more holes in the ground, on or parallel to the projected path of the wall, each of the one or more holes being drilled by means of a drill string; connecting one end of each drill string at the end of the drilling operation to one end of a casing string; pulling each casing string through the ground by retracting the drill string connected thereto; disconnecting each casing string from the corresponding drill string; connecting one end of each casing string to the wall building device; and pulling the wall building device through the ground by retracting the one or more casing strings. Accordingly, depending on the kind of wall to be built, in particular its cross-sectional area and its length, one or more drill strings and or one or more casing strings are used to pull the wall building device through the ground, using standard directional drilling techniques to bring the drill and casing strings into the ground. The directional drilling techniques are capable of very accurately following the projected path of the wall. The accuracy of the paths of the casing strings can be further improved by using a single drill string and by means of a connecting assembly connecting the ends of several casing strings to one end of the drill string and transversely spaced therefrom, which drill string is then pulled through the ground at the other end thereof.

In a preferred embodiment each casing string comprises an inner string and an outer string enclosing the inner string, the inner string being adapted to transfer the pulling force required by the wall building device, and the outer string being adapted to provide low friction forces when moving the inner string relative to the outer string. The outer string serves as a guide for the inner string when pulling the wall building device through the ground by the inner string. The friction forces between the inner string and the outer string can be still further reduced by supplying a fluid to the space between the inner string and the outer string.

Preferably, the inner string of the casing string is made of steel providing the strength needed, while the outer string is made of plastics, e.g. polyethylene providing an excellent low cost and low friction separation wall between the inner string and the ground.

When moving the wall building device through the ground, a hardenable material is injected behind it to form the wall. The wall material preferably is supplied to the wall building device through at least one of the one or more drill strings/casing strings used for pulling the wall building device through the ground. Additionally, at least one of the one or more drill strings/casing strings may contain at least one line for supplying energy, at least one line for controlling and/or monitoring the wall building device, at least one duct for supplying a drilling fluid to the wall building device, and/or at least one duct for discharging ground removed by the wall building device. Alternatively, or in addition thereto, the wall material and the drilling fluid may be supplied to the wall building device through ducts extruded in the wall. Such ducts can also be used for accommodating lines for supplying energy to the wall building device, or for controlling and/or monitoring the wall building device. Further, such ducts can be used for discharging ground removed by the wall building device.

For an improved positioning accuracy of different wall parts relative to each other, preferably the wall building device is adapted to build a wall or wall part provided with wall guide means, the or a further wall building device being provided with means for engaging the wall guide means. In this way the latter wall building device is allowed to exactly follow the path of the wall or wall part already in place in the ground. The wall guide means preferably comprise a guide slit, which may have an essentially L-shaped cross-section. More generally, in a preferred embodiment at least one guide member is provided in the ground, the wall building device is adapted to be guided along the guide member through the ground.

When a wall building device is used in a multi-pass mode, i.e. for subsequently passing through the ground along adjacent paths for building a wall from a plurality of separately built wall sections, preferably the wall building device is adapted to be connected to the leading end of a pulling string for pulling the pulling string into the ground simultaneously with pulling the wall building device through the ground. The pulling string is used for pulling the or a further wall building device through the ground in a next passage. For this purpose, the wall building device preferably has an essentially Z-shaped cross-section.

An essentially flat wall can be built in the ground by at least two wall building devices which at at least one side thereof are adapted to be coupled to another, which wall building devices further are adapted to be pulled through the ground in a forward direction, and in a direction at an angle to the forward direction.

For improving the quality of the wall, the wall material preferably is injected between one or more membranes defining one or more sides of the wall or wall part formed by the wall building device. The membrane or membranes can be stored in the wall building device in a folded or rolled-up form, and be unfolded or unrolled when injecting the wall material.

The friction between the wall building device and the surrounding ground, and the resistance the ground offers to the wall building device when pulling the wall building device through the ground is preferably reduced by vibrating, lubrication, jetting and/or removing the ground area adjacent to the front part of the wall building device.

The claims and advantages will be more readily appreciated as the same becomes better understood by reference to the following detailed description and considered in connection with the accompanying drawings in which like reference symbols relate to the same parts or parts having the same function. Arrows without reference numerals indicate normal directions of movement.

BRIEF DESCRIPTION OF THE DRAWINGS

FIG. 18 shows a cross-section of a structure built in the ground using the method, system and wall building device according to the invention;

FIG. 19 shows a cross-section of another structure built in the ground using the method, system and wall building device according to the invention;

FIG. 20 shows a cross-section of a further structure built in the ground using the method, system and wall building device according to the invention;

FIG. 21 shows a cross-section of still another structure built in the ground using the method, system and wall building device according to the invention;

DESCRIPTION OF THE PREFERRED EMBODIMENTS

Figure 1:
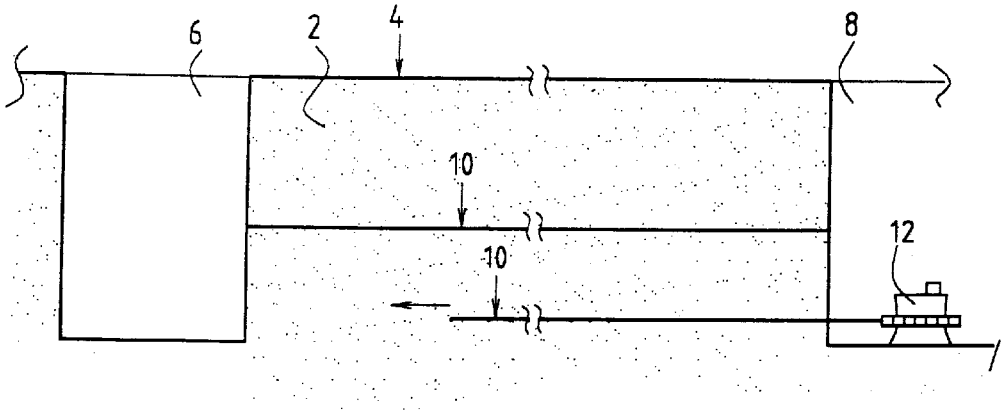
FIG. 1 shows a vertical cross-section of a ground area in which a tunnel is to be built, illustrating a first operation.
Figure 2:
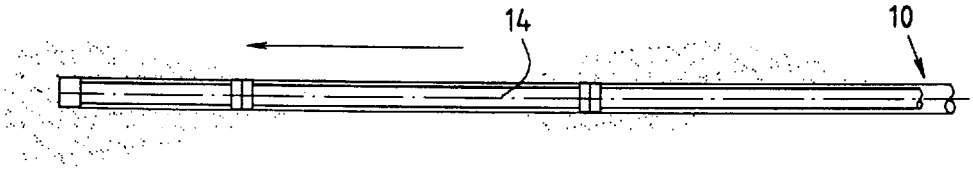
FIG. 2 shows on an enlarged scale a drill string used in the operation shown in FIG. 1.

As FIGS. 1 and 2 illustrate, in the given example of a tunnel building method it is assumed that a tunnel is to be built in the ground 2 under the ground surface 4 from a first construction pit 6 to a second construction pit 8. From the second construction pit 8 a number of pilot holes 10 are drilled using conventional directional drilling techniques, as described e.g. in "Tunnels & Tunnelling", published by Morgan-Grampian, November 1996, in particular on page 15. A directional drilling unit 12 pushes a drill string 14 through the ground from the second construction pit 8 to the first construction pit 6. The pilot holes are drilled on or parallel to the projected path of the tunnel wall.

Figure 3:
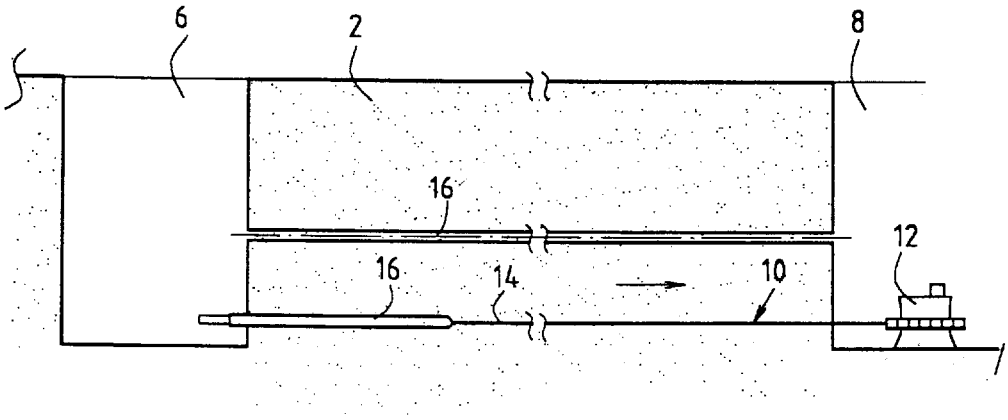
FIG. 3 illustrates a next operational step in the ground.
Figure 4:
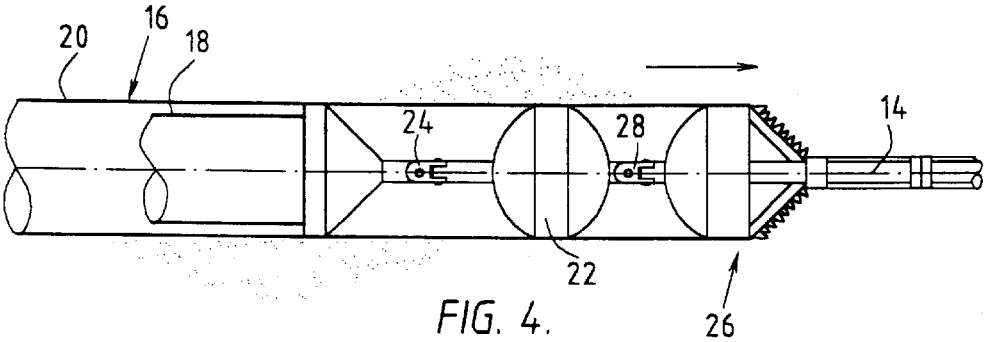
FIG. 4 shows on an enlarged scale a part of the pulling means used in the operation illustrated in FIG. 3.

As FIGS. 3 and 4 illustrate, after having reached the first construction pit 6, the front end of the drill string 14 is connected to the front part of a casing string 16, after which the casing string 16 is pulled through the ground along the path of the pilot hole 10 by the directional drilling unit 12. As a result of this operation, casing strings 16 are installed in the ground along the projected path of the tunnel wall.

As FIG. 4 shows in more detail, the casing string 16 comprises a steel casing 18 enclosed in a plastic, preferably polyethylene (PE) tube 20. The casing string 16 is connected to a buoy 22 by a flexible coupling 24, which buoy 22 in turn is connected to a reaming device 26 by a flexible coupling 28. When the projected tunnel wall has a ring-shaped cross-section, preferably at least four casing strings 16 are installed in the ground 2 spaced along the periphery of the cross-section.

Figure 5:
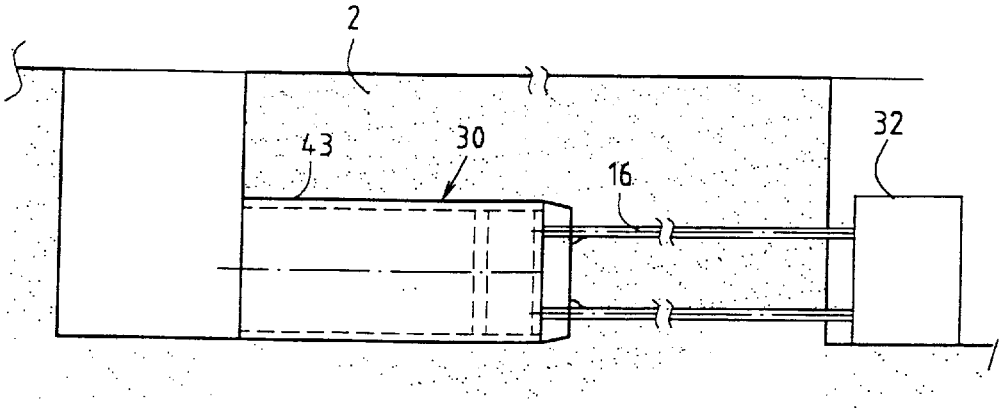
FIG. 5 illustrates the next operational step in the ground in the process of building a tunnel wall.
Figure 6:
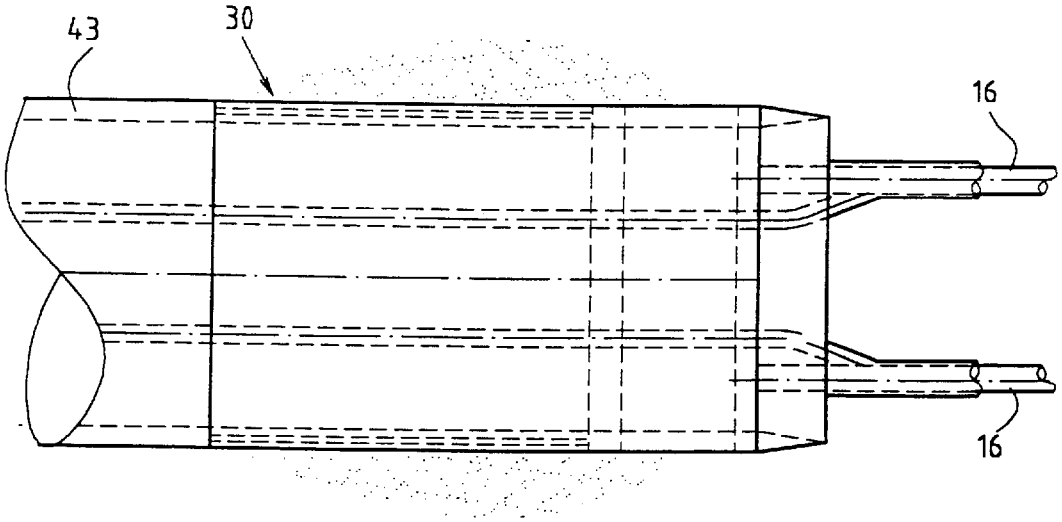
FIG. 6 shows on an enlarged scale a side view of a tunnel wall building device shown in FIG. 5.
Figure 7:
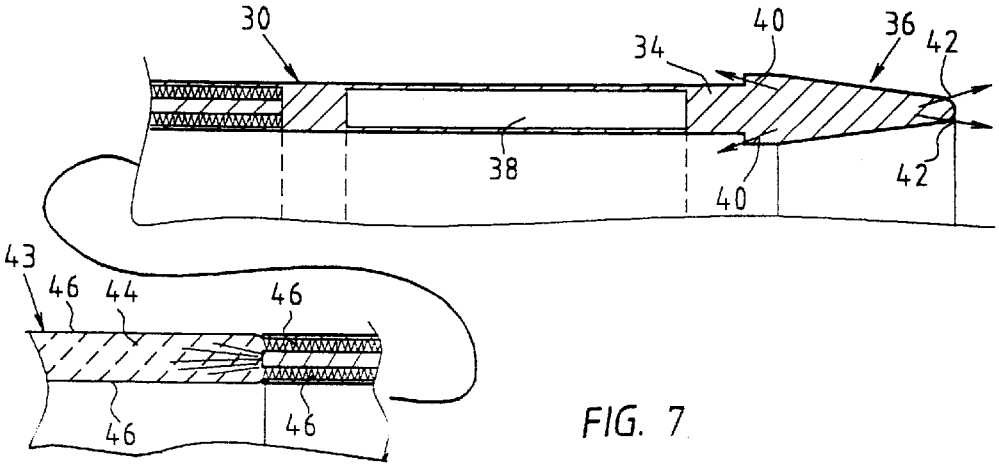
FIG. 7 schematically shows a longitudinal cross-section of the tunnel wall building device shown in FIG. 6.

As FIGS. 5–7 illustrate, the back ends of the casing strings 16 are connected to the front end of a tunnel wall building device 30, which has cross-sectional dimensions which are substantially equal to the dimensions of at least a part of the cross-section of the tunnel wall, and which is pulled through the ground 2 by pulling means 32 (not shown in further detail) pulling simultaneously all casing strings 16.

The wall building device 30 comprises a body 34 with a conical-shaped front part 36, which is rounded at the front end thereof. Behind the front part 36, in the body 34 one or more vibration units 38 can be provided to reduce the friction between the wall building device 30 and the ground, and to reduce the forces required to displace the ground with the front part 36 while moving through the ground. Directly behind the front part 36 a fluid 40, e.g. supplied through one of the casing strings 16, may be injected to further reduce the friction between the wall building device 30 and the ground 2. The front part 36 is designed to minimize the effects on the surrounding ground area, to avoid plug forming in the wall building device 30, and to minimize the required force for advancing the wall building device 30. Near the front end of the front part 36 a jetting member 42 may be provided to improve the ground displacement, the jetting fluid e.g. being supplied through one of the casing strings 16. Furthermore, the front part 36 may be made in segments which are movable in the radial direction to allow for small corrections of the path of the wall building device 30 moving through the ground 2.

At the rear end of the wall building device 30, the tunnel wall 43 is extruded by pumping the wall material 44 into the gap created by the wall building device 30. The pressure of the wall material 44, which preferably is fiber concrete, ensures the stability of the ground and prevents settlements thereof. The pressure also provides a force in the direction of advance of the wall building device 30. The wall material 44 does not need to have direct strength, and only has to stabilize the gap created by the wall building device 30 at the rear end thereof.

The wall material 44 is extruded between membranes 46 which can be stored in concertina fashion in spaces provided therefore in the body 34 of the wall building device 30. The membranes 46 are folded up in the body 34, and unfold when the wall building device advances. The membranes 46 prevent leakage of the wall material into the ground, ensure stabilization of the tunnel wall 43, provide (extra) water tightness, and provide a quality assurance.

The use of one or more membranes in the method, system and wall building device according to the invention is not essential; normally membranes can be omitted, and are used only if special requirements, such as wall quality, water tightness, etc. are to be met.

The wall material 44 is supplied to the wall building device 30 through one or more of the casing strings 16, in particular through the steel casing 18 thereof. As will be clear from FIG. 6, the tubes 20 of the casing string 16 are cut in front of the wall building device in a manner not shown in further detail. The cut tube 20 is directed to the inside of the tunnel wall 43, and can be removed during or after excavating the ground inside the tunnel wall 43. The longitudinally cut tube can also be reused to protect power supply or signal lines, or can serve other useful purposes when the tunnel is completed. The body 34 of the wall building device 30 comprises channels not shown in further detail guiding the wall material supplied through the casing strings 16 to the rear end of the wall building device 30 between the membranes 46, and may also comprise other channels not shown in further detail to guide fluid supplied through the casing strings 16 for lubrication and jetting.

Figure 8:
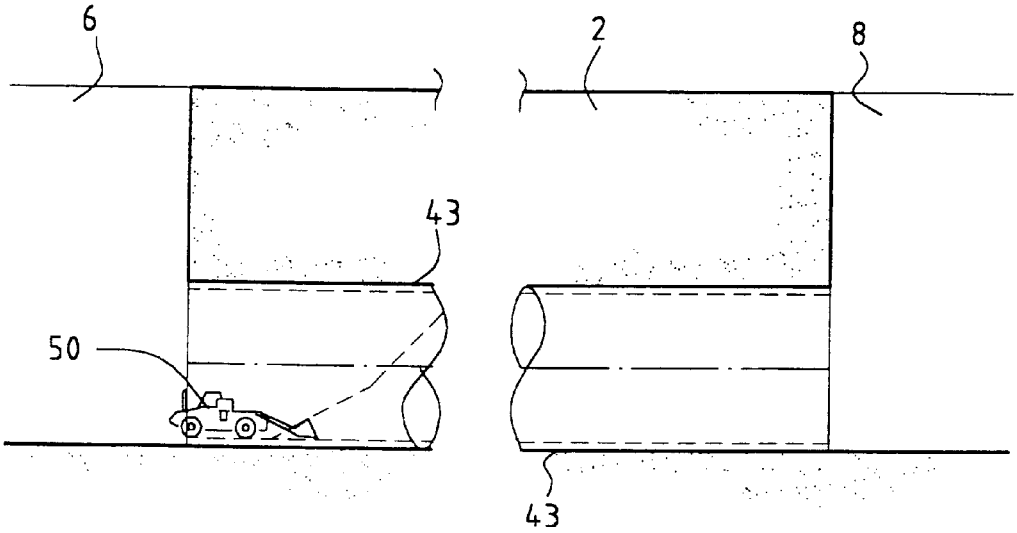
FIGS. 8 and 9 illustrate different methods of excavating a tunnel within the wall.
Figure 9:
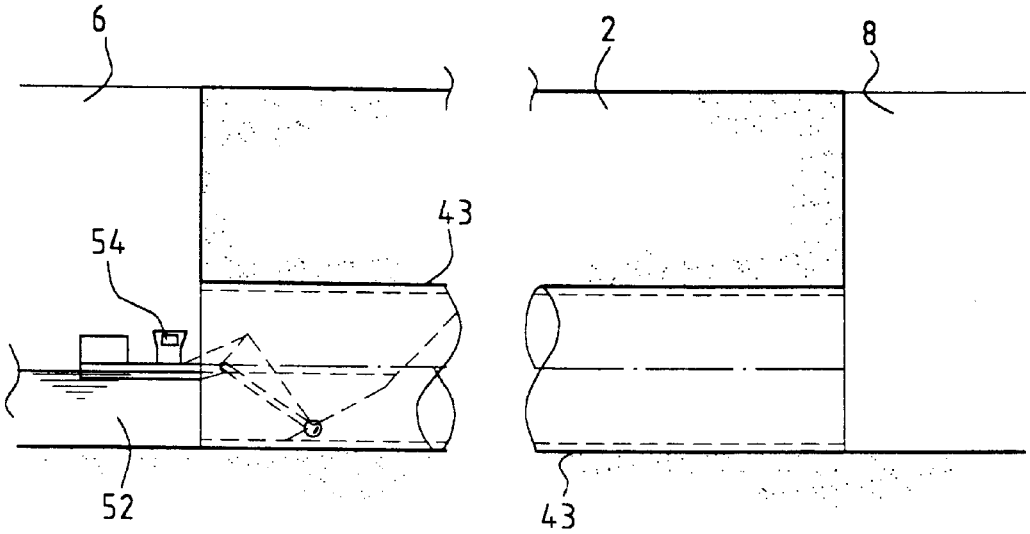

As FIGS. 8 and 9 illustrate, after the tunnel wall has been completed and has sufficient strength, the ground inside the tunnel wall can be excavated using a dragline 50 (FIG. 8) or, when the level of the ground water 52 is high, conventional dredging equipment 54 (FIG. 9) can be used.

It will be clear that the wall building device 30 can also, under circumstances, be pulled through the ground by the drill strings 14, which at the same time may serve to supply the wall material 44 to the wall building device. Further it is possible to construct the tunnel wall in separate elongated parts: a tunnel with a rectangular cross-section may be constructed by subsequently building the top wall, the bottom wall and the side walls, after which the ground inside the thus completed tunnel wall is excavated. Yet another possibility is building a first tunnel wall and subsequently building one or more additional tunnel walls enclosing the first tunnel wall, or inside the first tunnel wall. The different tunnel walls may have different properties: one being designed for watertightness, another being designed for strength.

Figure 12:
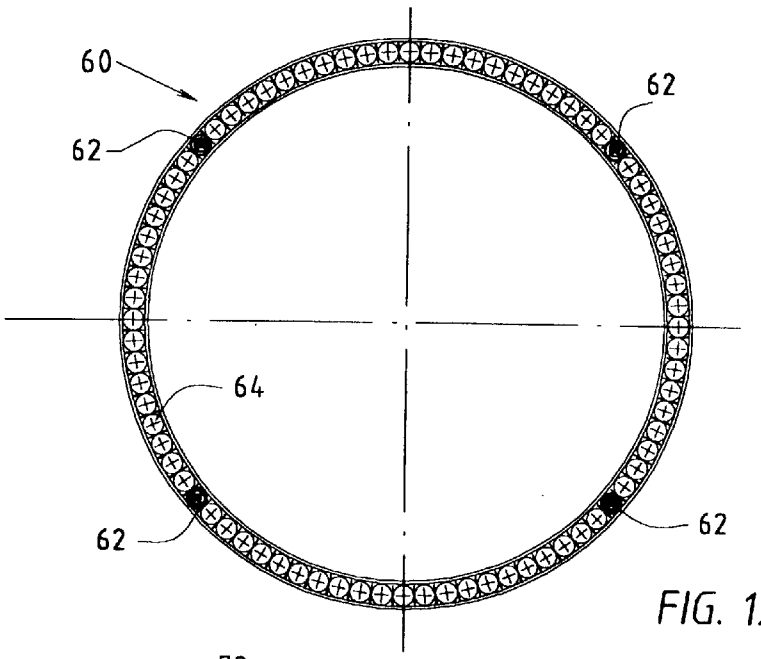
FIG. 12 shows a front view of the tunnel wall building device of FIG. 10.
Figure 10:
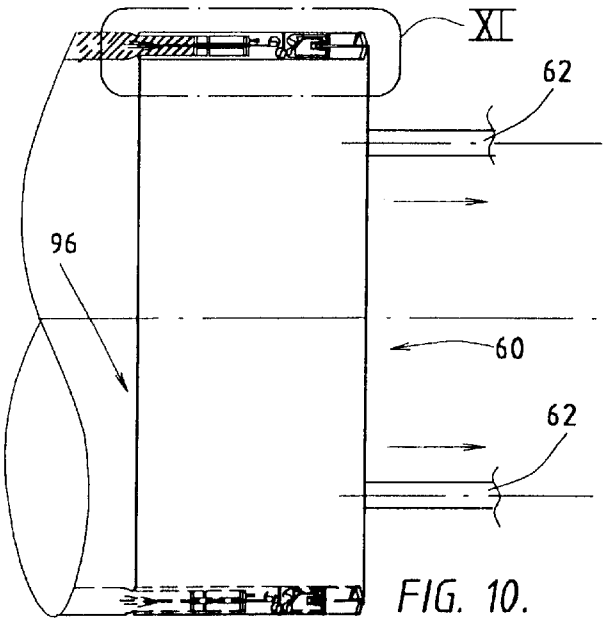
FIG. 10 shows a side view, partially in cross-section, of another embodiment of the tunnel wall building device according to the invention.
Figure 11:
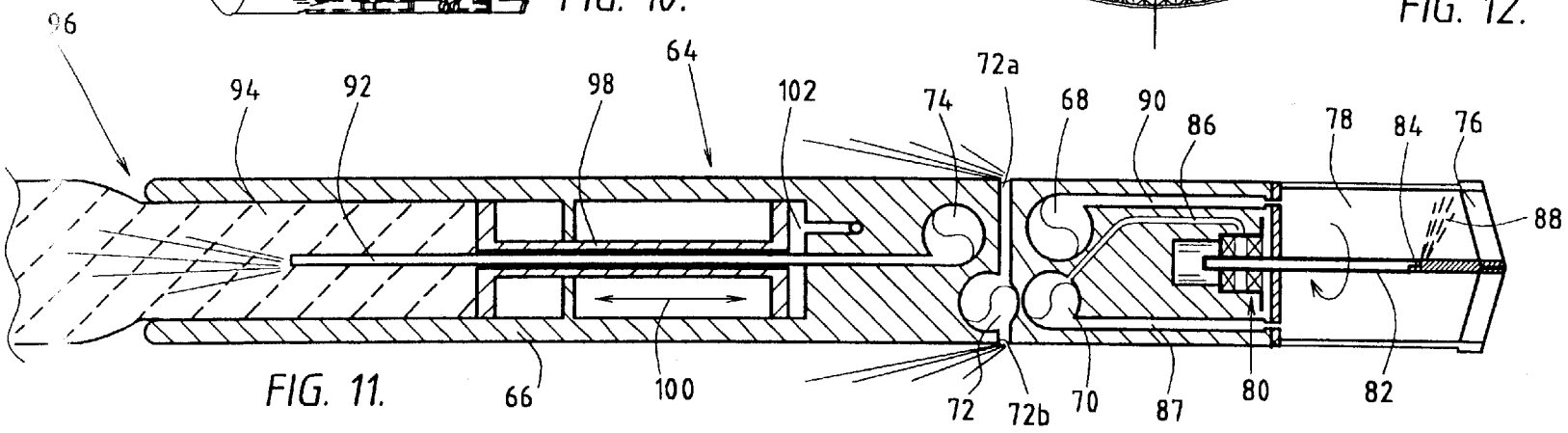
FIG. 11 shows on an enlarged scale a cross-section of a detail XI of the tunnel wall building device of FIG. 10.

FIGS. 10, 11, and 12 show a tunnel wall building device 60 being pulled through the ground by means of four pulling strings 62 not shown in further detail. The wall building device 60 comprises eighty jetting and extruding units 64 arranged along the ring-shaped front side of the wall building device 60.

As shown in FIG. 11, each jetting and extruding unit 64 comprises a body 66 having four main ducts 68, 70, 72, and 74 formed therein. The ducts 68, 74 of different jetting and extruding units 64 are in fluid communication with each other and may further be in fluid communication with one or more ducts in a pulling string 62. At its front part the jetting and extruding unit 64 comprises a grid 76 keeping stones and other large objects out of a jetting chamber 78 situated behind the grid 76. In the jetting chamber 78, a rotating jetting device is mounted comprising a fluid driven motor 80 driving a tube 82 which is provided with a jet opening 84. From the duct 70 a fluid, such as water, is fed under pressure through a duct 86 to the fluid motor 80 making the tube 82 rotate. Said fluid further is fed to the jet opening 84, thus creating a rotating jet 88. From the duct 70 fluid is also fed through a duct 87 to the jetting chamber 78, mixing there with the ground jetted by the jet 88. The ground/fluid mixture is removed from the jetting chamber 78 through a duct 90 to the duct 68.

For lubrication of the inner and outer sides of the tunnel wall building device 60, a lubricating fluid is fed from the duct 72 through the duct 72*a* and 72*b* out of the body 66 of the jetting and extruding unit 64.

From the duct 74 a hardenable material is fed through a duct 92, after which the hardenable material is extruded at the trailing end 96 of the jetting and extruding unit 64 to form a tunnel wall. In the extruding chamber 94 a piston unit 98 is provided which is movable in the directions indicated by double arrow 100. A chamber 102 is filled with a fluid under pressure ensuring a constant pressure on the hardenable material in the extruding chamber 94 despite of variations in the ground travelling speed of the wall building device 60 or variations in the pressure of the hardenable material in the ducts 74 and 92.

In an alternative embodiment, the tunnel wall building device according to FIGS. 10, 11 and 12 comprises only one annular body 66 connected to eighty jetting chambers 78, each containing a tube 82 driven by a fluid driven motor 80. In the annular body 60, at regular angular intervals ducts 72*a*, 72*b* and 92 are provided. In this embodiment the piston unit 98 has a generally annular shape, like the body 66.

Figure 13:
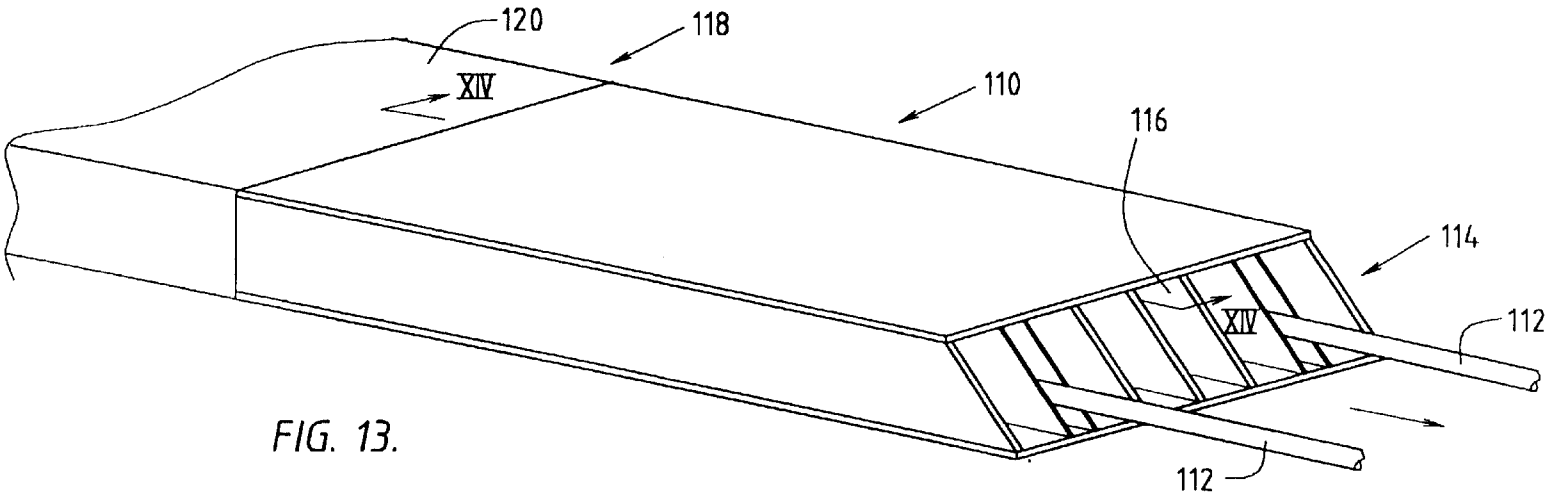
FIG. 13 shows a perspective view of a wall building device according to the invention.
Figure 14:
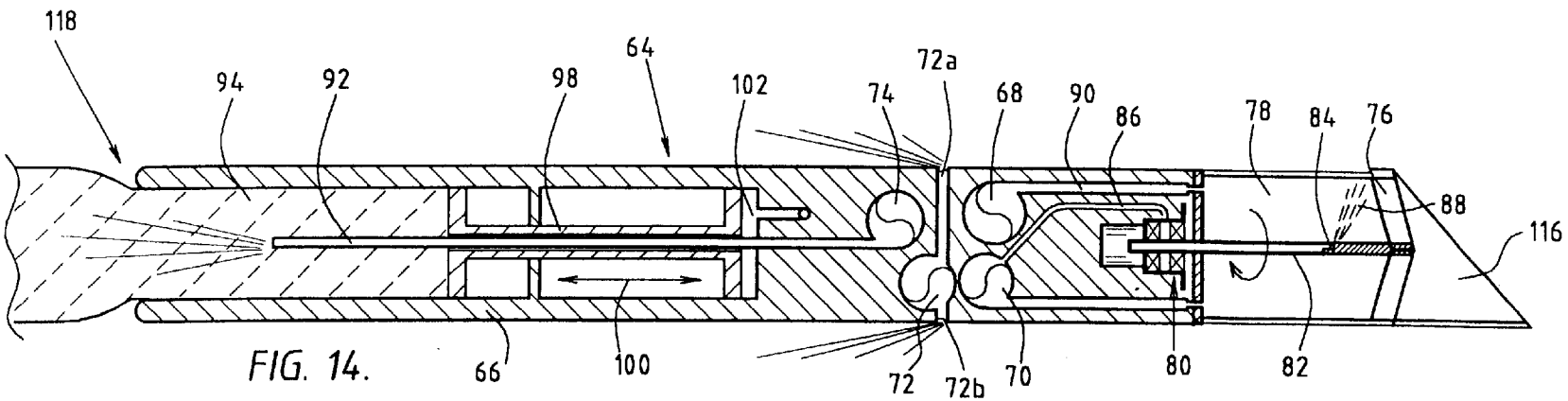
FIG. 14 shows on an enlarged scale a cross-section of the wall building device of FIG. 13 taken along the line XIV—XIV.

FIGS. 13 and 14 show a wall building device 110 having an essentially rectangular cross-section, as seen at right angles to the direction of movement in the ground. The wall building device 110 is pulled through the ground by means of two pulling strings 112 not shown in further detail. At the leading side 114 of the wall building device 110 a number of plates 116 are provided to prevent stones and other large objects from entering into the jetting chambers 78 of a plurality of jetting and extruding units 64 accommodated next to each other in the wall building device 110. At the trailing side 118 of the wall building device 110 a wall 120 is formed having a substantial rectangular cross-section. The jetting and extruding units 64 of the wall building device 110 are similar to those of the tunnel wall building device 60 and a discussion thereof is omitted here. Alternatively, the wall building device 110 may comprise only one extruding chamber 94 in a substantially unitary body 66, connected to several jetting chambers 78.

Figure 15:
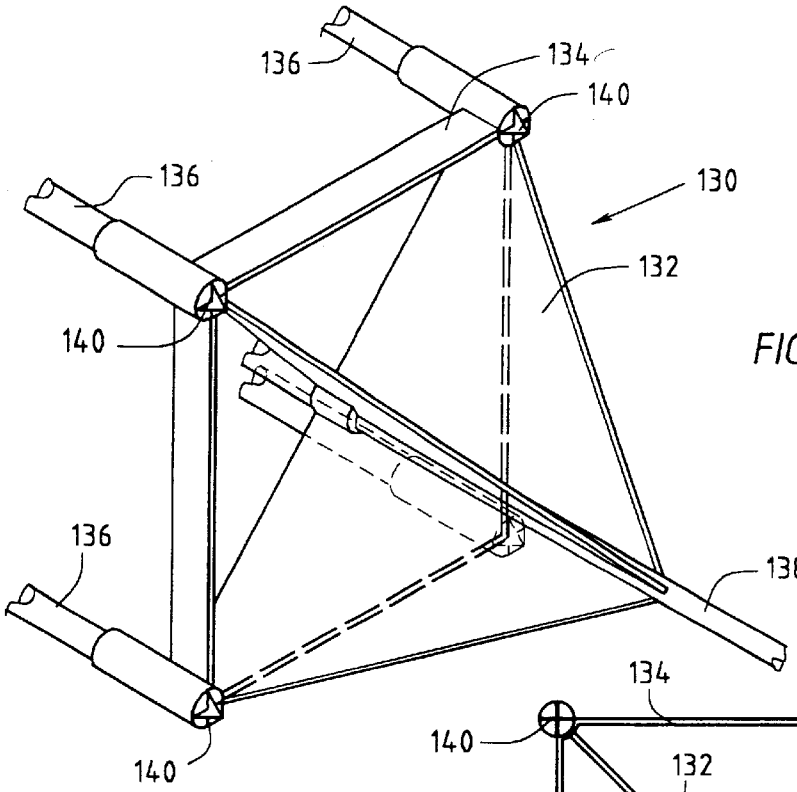
FIG. 15 shows a perspective view of an assembly used for simultaneously pulling four casing strings through the ground.
Figure 16:
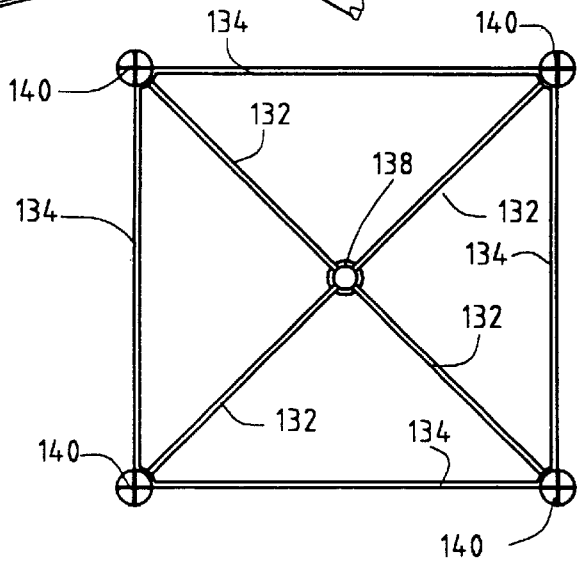
FIG. 16 shows a front view of the assembly of FIG. 15.
Figure 17:
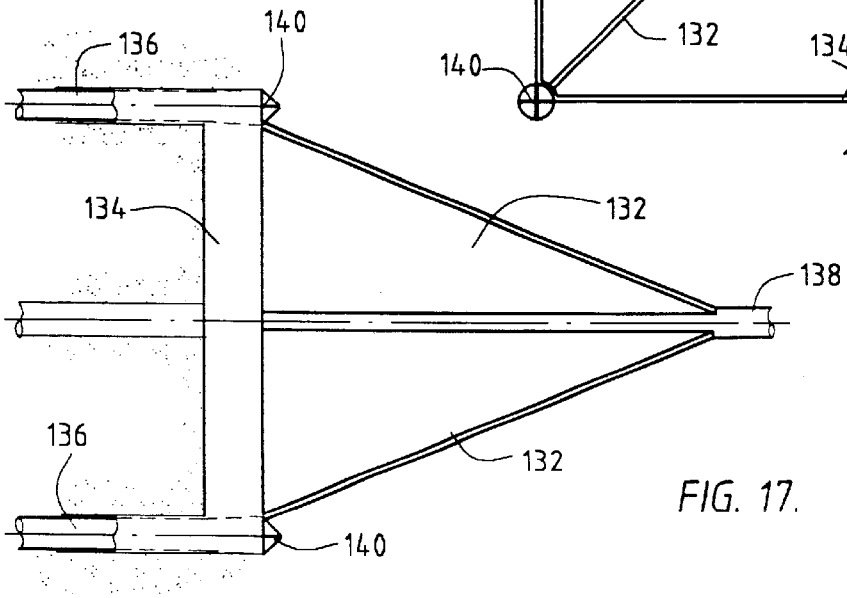
FIG. 17 shows a side view of the assembly of FIG. 15.

FIGS. 15, 16, and 17 show a connecting assembly 130, being a frame made of triangular plates 132 and rectangular plates 134 connecting the ends of casing strings 136 with the end of a pull string, such as a drill string 138. At the point where the assembly 138 is connected to one of the casing strings 136, a drilling, reaming and/or jetting head 140 is provided. With the assembly 130 it is possible to bring a number of casing strings 136 in the ground exactly parallel to each other, which would be more difficult if for each of the casing strings a separate drill string would be used. The assembly 130 may take various forms, depending on the number of casing strings 136 to be connected and their position relative to each other.

FIG. 18 shows an open channel built in the ground 2 by subsequently or simultaneously building walls 150, 152 and 154.

FIG. 19 shows another open channel built by subsequently or simultaneously building a wall 156 and 158 in the ground 2.

FIG. 20 shows an open channel in the ground 2 built by forming a wall 160 with a semi-circular cross-section in the ground 2.

Figure 20A:
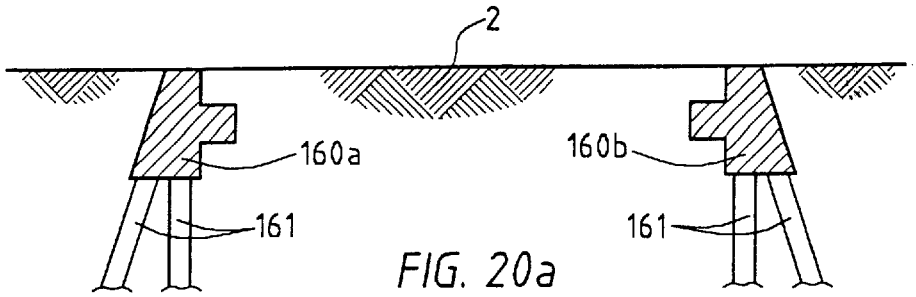
FIGS. 20*a*–20*d* illustrate a method for building a structure similar to the one shown in FIG. 20.

As FIG. 20*a* in a cross-sectional view shows, in a first stage of building a wall with a semi-circular or similar cross-section two elongated wail parts or guide beams 160*a* and 160*b* defining the path of the complete wall are provided in the ground 2 near the surface, e.g. by digging trenches in the ground and forming the guide beams 160*a*, 160*b* in situ, or by placing unit lengths of prefabricated guide beam parts in the ground 2. The guide beams 160*a*, 160*b* are supported and fixed in the ground 2 by piles 161 driven into the ground 2 in a manner known per se. It should be pointed out here that under the same or other circumstances guide beams or wall parts such as the ones shown in FIG. 20*a* for the same use can also be formed or placed on instead of in the ground, in part or as a whole. Further, it is also not essential that the guide beams or wall parts are fixed in or on the ground.

Figure 20B:
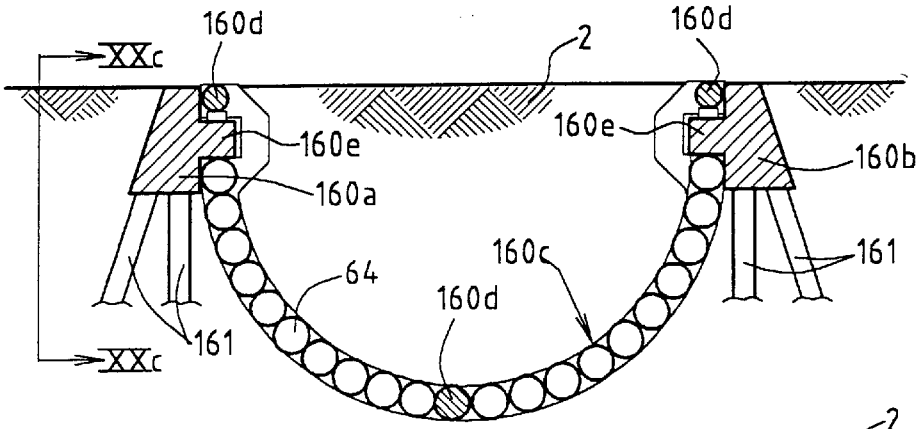
Figure 20D:
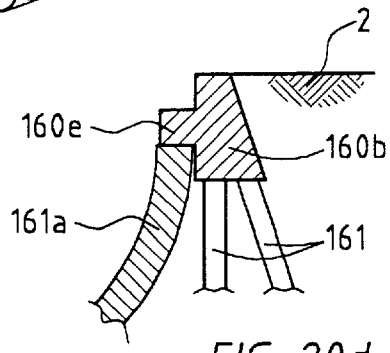
Figure 20C:
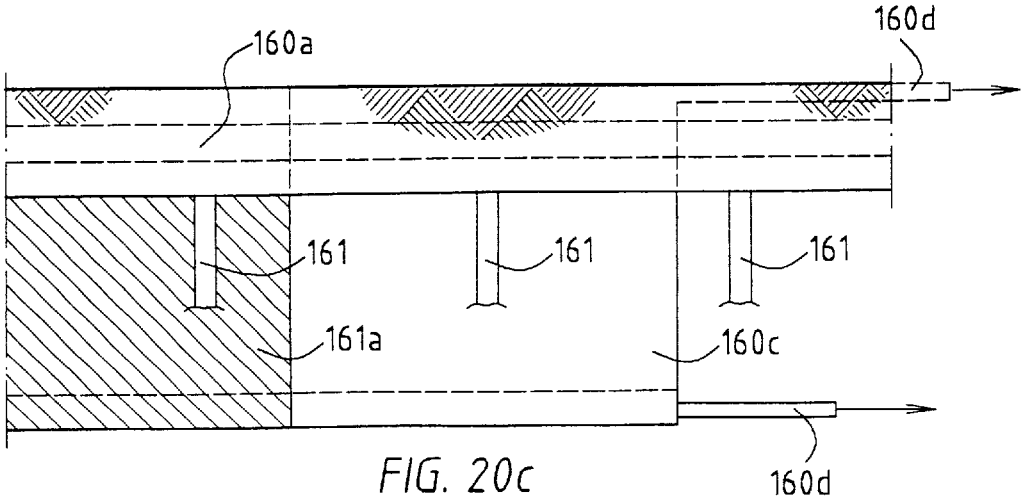

Then, as FIG. 20*b* in a cross-sectional view and FIG. 20*c* in a side view according to arrow XXc in FIG. 20*b* show, a wall building device 160*c* having an essentially semicircular cross-section is pulled through the ground 2 by means of three pulling strings 160*d*—at least one of which being a drill string or a casing string-in the indicated direction. Alternatively, the wall building device 160*c* may be pulled through the ground only by the lowest pulling string 160*d*, while the other two upper strings are replaced by other means for moving the wall building device 160*c* by means of a pulling or a pushing force, such as one or more lorries, jacks, etc. The wall building device 160*c* is guided along its path in the ground 2 in a manner not shown in further detail by opposite ribs 160*e* being part of the guide beams 160*a*, 160*b*. The wall building device 160*c* is fitted with thirty-four jetting and extruding units 64 the structure and operation of which have already been explained in connection with FIG. 11. As FIG. 20*c*, and FIG. 20*d* in a partial cross-section show, with the wall building device 160*c* a wall 161*a* is formed which is connected to, and fixed by the guide beams 160*a*, 160*b*, at least in the upward and lateral directions, and possibly also in the longitudinal and downward directions in a manner not shown in further detail. During the building process, the pulling strings 160*d* may be used for supplying wall material, drilling fluid and energy to the wall building device 160*c*, for discharging ground removed by the wall building device, and/or for accommodating lines for controlling and monitoring the wall building device. Of course, at least part of these functions can also be performed above ground, since the top side of the wall building device 160*c* is near or above ground level. Further, it will be clear that a similar, appropriately reshaped wall building device as the one shown in FIGS. 20*b* and 20*c* can be used for building the channels shown in FIGS. 18 and 19 each with a wall in one piece, using guide beams similar to the ones shown in FIGS. 20*a*, 20*b* and 20*d*.

In the process of building the walls 150–160 and 161*a* of the channels according to FIGS. 18–20 and 20*a*, the walls 150–160 and 161*a* are built first, while the ground between the walls 150–152 (FIG. 18), between the walls 156 and 158

(FIG. 19), and at the concave side of the walls 160 and 161*a* (FIGS. 20 and 20*d*, respectively) is excavated afterwards.

FIG. 21 shows a wall 162 in the ground 2, the wall 162 having ducts 164 extruded therein by appropriately designing the trailing portion of the extruding chamber of the wall building device used for building the wall 162. The ducts 164 may be used for supplying the wall material, drilling fluid and energy to the wall building device, for discharging ground removed by the wall building device, and/or for accommodating lines for controlling and monitoring the wall building device.

Figure 22:
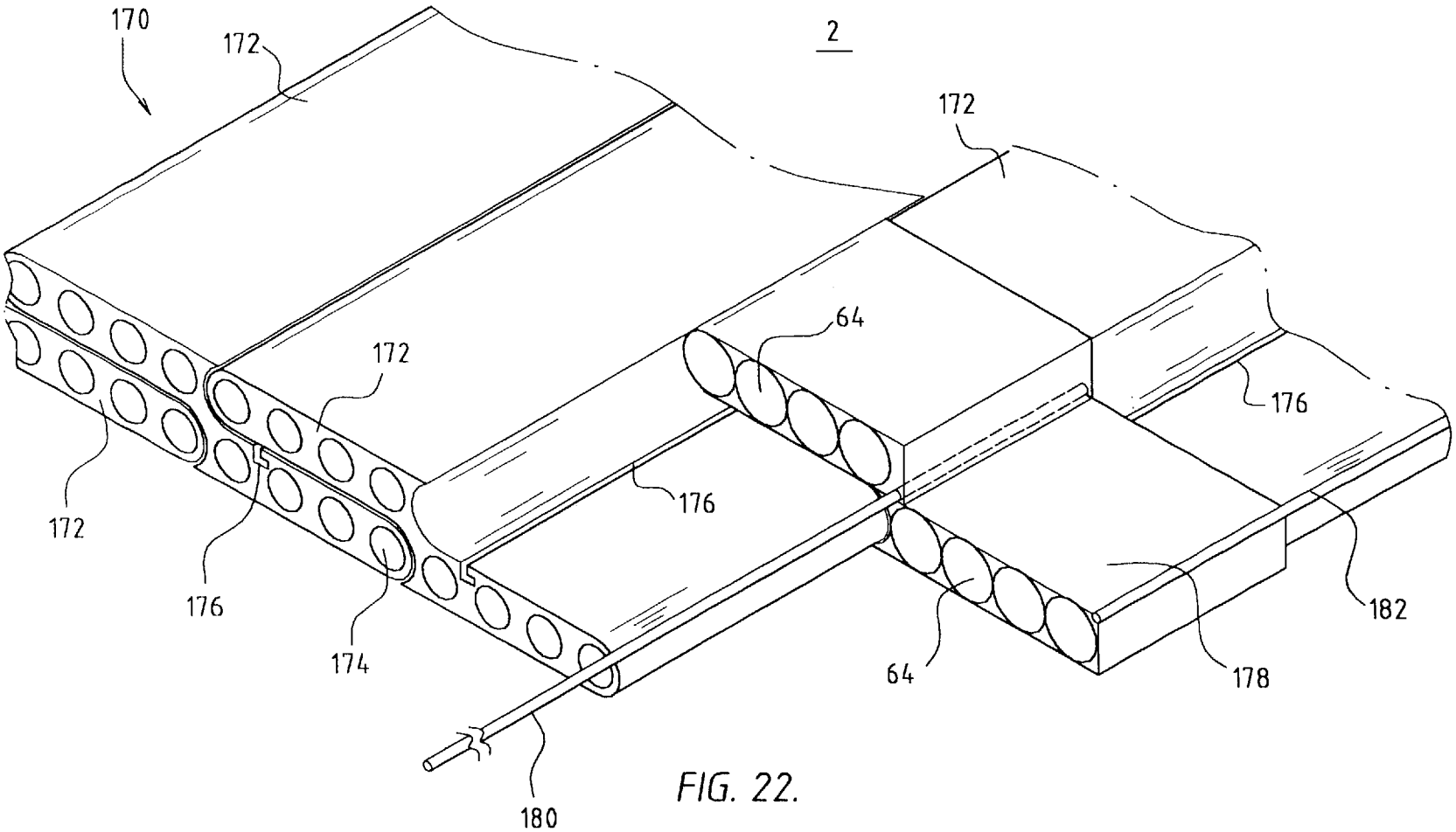
FIG. 22 illustrates in perspective view the process of building a composite wall made from uniformly shaped wall sections.

FIG. 22 shows a composite wall 170 in the ground 2 made from a plurality of interconnecting, uniform, generally Z-shaped wall sections 172 having ducts 174 extruded therein. Each wall section 172 is provided with a guide slit 176 having a generally L-shaped cross-section. A wall building device 178 with a cross-sectional shape similar to the cross-sectional shape of the wall sections 172 is used for building the wall sections 172 by the action of eight jetting and extruding units 64 removing ground material and extruding wall material at the appropriately shaped trailing side of the wall building device 178. A pulling string 180 (which may be a drill string or a casing string), fixed centrally to the wall building device 178 in a manner not shown in further detail, is used for pulling the latter through the ground 2 in the direction indicated by the arrow. At the same time, another pulling string 182 of which the leading end is fixed at the side of the wall building device.178, is pulled into the ground. The trailing end of the pulling string 182 is used for pulling the wall building device 178 through the ground 2 in a next passage thereof for forming a next wall section 172. In said next passage, the trailing end of the pulling string 182 is fixed centrally to the wall building device, like the pulling string 180. It will be clear that by using a pulling string for pulling both a wall building device and the leading end of at least one other pulling string through and into the ground, considerable time and cost savings can be achieved in a multi-pass process using the same wall building device.

During passage through the ground 2, the wall building device 178 is guided in a desired position relative to a wall section 172 formed before by a generally L-shaped foot (not shown) connected to the device 178 and sliding in the guide slit 176. Also at other points the wall building device 178 is guided by an adjacent wall section 172, as appears clearly from FIG. 22. The guide slit and the foot may e.g. also be T-shaped or J-shaped.

Figure 23A:
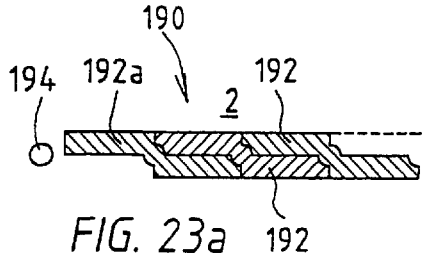
FIGS. 23*a*–23*g* in cross-sectional view show different stages in building composite walls made from uniformly shaped wall parts.

FIG. 23*a* shows a composite wall 190 in the ground 2 essentially made from a plurality of interconnecting, uniform, generally Z-shaped wall sections 192, 192*a*. The wall sections 192 have been built essentially in the way illustrated and explained according to FIG. 22. The last wall section that has been built is wall section 192*a*. During the building of wall section 192*a*, a leading end of a pulling string 194 has been pulled into the ground 2 in a manner not shown in further detail by connecting the pulling string 194 to the wall building device (not shown) used for building the wall section 192*a*, similar to the use of the pulling string 182 in FIG. 22.

Figure 23B:
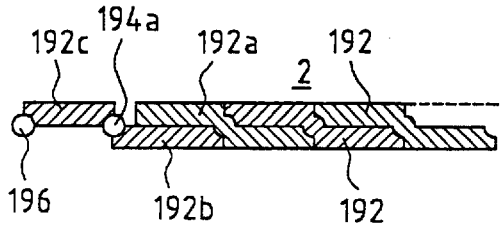

As FIGS. 23*a* and 23*b* illustrate, next the pulling string 194 is used for pulling a wall building device (not shown) connected to a leading end of a new pulling string 196 and the leading end of a further part 194*a* of the pulling string 194 through the ground 2 for building wall sections 192*b* and 192*c* being separated from each other.

Figure 23C:
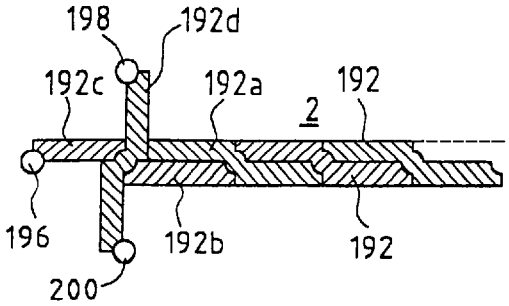

As FIGS. 23*b* and 23*c* illustrate, next the pulling string 194*a* is used for pulling a wall building device (not shown) connected to leading ends of new pulling strings 198 and 200 through the ground 2 for building a wall section 192*d* essentially at right angles to the other wall sections 192, 192*a*, 192*b* and 192*c*. The wall building device used in this step may the same as the wall building device used for building the last-mentioned wall sections.

Figure 23D:
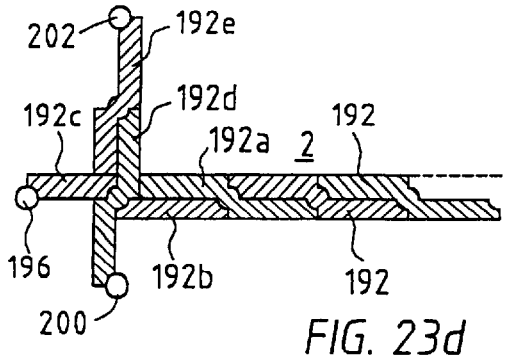

As FIGS. 23*c* and 23*d* illustrate, next the pulling string 198 is used for pulling a wall building device (not shown) connected to a leading end of a new pulling string 202 through the ground 2 for building a wall section 192*e*.

Figure 23E:
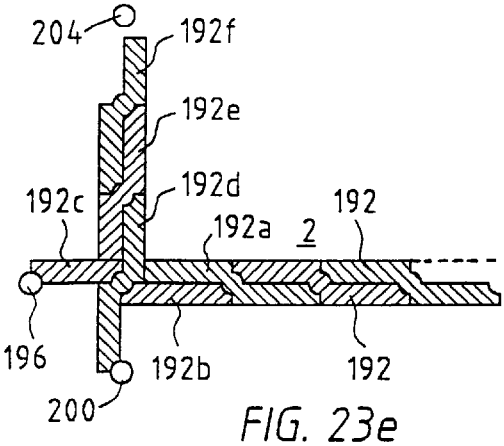

As FIGS. 23*d* and 23*e* illustrate, next the pulling string 202 is used for pulling a wall building device (not shown) connected to a leading end of a new pulling string 204 in a manner not shown in further detail through the ground 2 for building a wall section 192*f*.

Figure 23F:
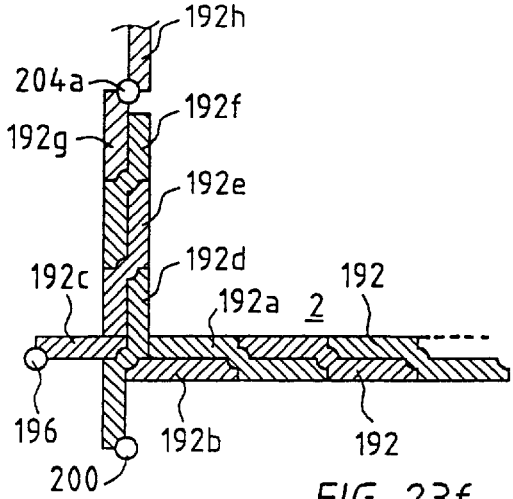

As FIGS. 23*e* and 23*f* illustrate, next the pulling string 204 is used for pulling a wall building device (not shown) connected to the leading end of a further part 204*a* of the pulling string 204 through the ground 2 for building wall sections 192*g* and 192*h* being separated from each other.

Figure 23G:
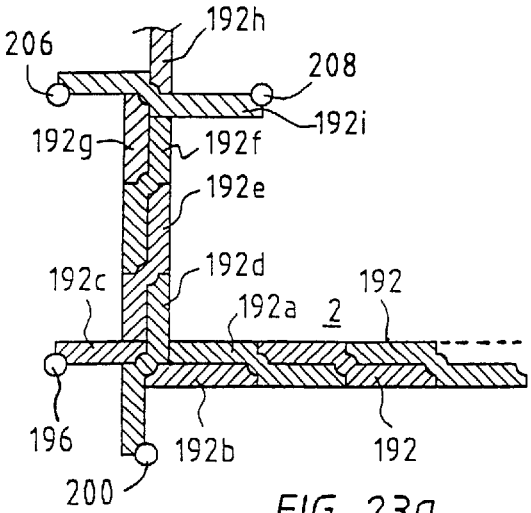

As FIGS. 23*f* and 23*g* illustrate, next the pulling string 204*a* is used for pulling a wall building device (not shown) connected to leading ends of new pulling strings 206 and 208 through the ground 2 for building a wall section 192*i* essentially at right angles to wall sections 192*d*–192*h*.

The wall building method illustrated in FIGS. 23*a*–23*g* provides a grate flexibility in building complex wall structures from basic, essentially uniform wall sections. At any rate, basically only one type of wall building device is needed to build the wall sections 192, 192*a*–192*i* by changing, whenever necessary, the extrusion profile thereof, e.g. by putting into or taking out of operation different jetting and extruding units 64 included in the wall building device.

Further, wall sections may take different shapes than the ones shown in FIGS. 23*a*–23*g*, possibly for establishing different angles than right angles between walls made up of the wall sections.

Figure 24A:
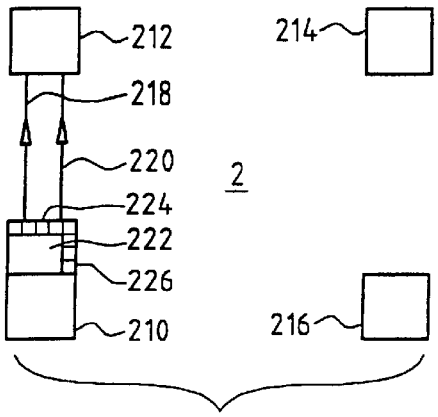
FIGS. 24*a*–24*c* in top view schematically illustrate a further process of building a wall according to the invention.

FIG. 24*a* shows four construction pits 210, 212, 214 and 216. Similar to the method described in connection with FIGS. 1–4, two pulling strings 218, 220 (which may be drill strings or casing strings or similar) have been placed in the ground 2 between the construction pit 210 and the construction pit 212. The pulling strings 218 and 220 are used for pulling in the direction indicated by the arrows a wall building device 222 along a path from the construction pit 210 to the construction pit 212. The wall building device 222 at its leading side has five jetting or other excavating devices 224 which are indicated only schematically. Further, the wall building device 222 is provided with a plurality of jetting and extruding units of which the jetting parts 226 are located at the side of the wall building device 222 facing the construction pits 214 and 216. During the passage of the wall building device 222 from the construction pit 210 to the construction pit 212, only the jetting devices 224 are in operation; the jetting and extruding units are inoperative.

Figure 24B:
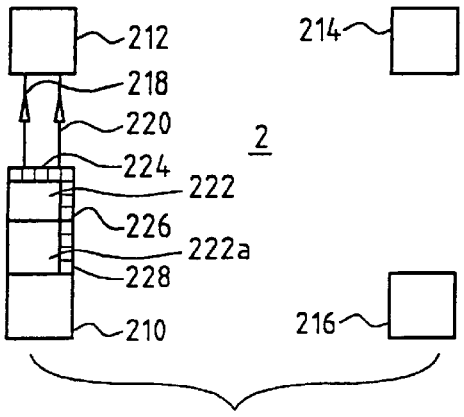

As FIG. 24*b* illustrates, the trailing side of the wall building device 222 is connected to a further wall building device 222*a* having a plurality of jetting and extruding units of which the jetting parts 228 are located at the side of the wall building device 222*a* facing the construction pits 214 and 216. The jetting and extruding units of the wall building device 222*a* are inoperative during the passage of the wall building device 222*a* from the construction pit 210 to the construction pit 212, whereas the jetting devices 224 remain in operation. A further wall building device 222*b* (FIG. 24*c*) is connected to the wall building device 222*a*, and has essentially the same structure as the wall building device 222*a*. To the wall building device 222*b* a further wall building device 222*c* (FIG. 24*c*) is connected, having essentially the same structure as the wall building devices 222*a* and 222*b*. The four wall building devices 222 and 222*a*–222*c* together bridge the distance between the construction pits 210 and 212.

Figure 24C:
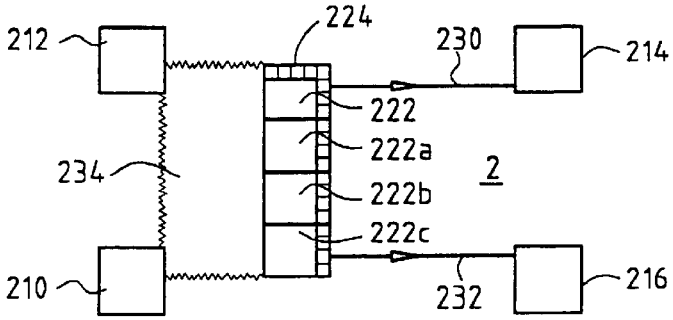

As FIG. 24*c* illustrates, next the assembly of wall building devices 222 and 222*a*–222*c* is pulled by pulling strings 230 and 232 (which may be drill strings or casing strings or similar) in the indicated direction to the construction pits 214 and 216. The pulling strings 230 and 232 have been pre-installed between the construction pits 212 and 214, and the construction pits 210 and 216, respectively, in a similar manner as described with reference to FIGS. 1–4. During passage of the assembly of wall building devices 222 and 222*a*–222*c* through the ground 2, the jetting devices 224 are out of operation, while the jetting and extruding units of the wall building devices 222 and 222*a*–222*c* are in operation, building a wall 234 between the construction pits 212–216.

Figure 25A:
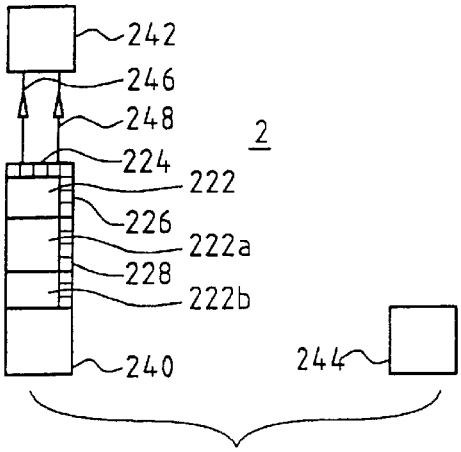
FIGS. 25*a* and 25*b* in top view schematically illustrate a still further process of building a wall according to the invention.
Figure 25B:
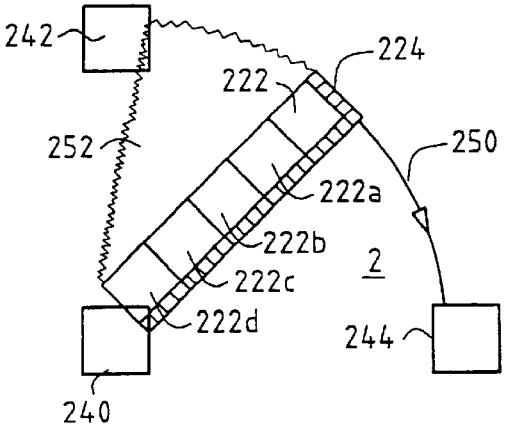

FIGS. 25*a* and 25*b* show three construction pits 240, 242 and 244. Between the construction pits 240 and 242 an assembly of wall building devices 222 and 222*a*–222*d* is installed in a manner already explained with reference to FIG. 24*b* by means of pulling strings 246 and 248 (which may be drill strings or casing strings or similar). Next, by means of a pulling string 250 one end of the assembly of wall building devices 222 and 222*a*–222*d* is pulled to the construction pit 244, while the other end of the assembly remains rotatingly connected to the construction pit 240, thus building a circle segment shaped wall 252 by having the jetting and extruding units of the assembly of wall building devices 222 and 222*a*–222*d* in operation, while the jetting devices 224 are inoperative.

While the invention has been described and illustrated in its preferred embodiments, it should be understood that departures may be made therefrom within the scope of the invention, which is not limited to the details disclosed herein.

What is claimed is:

1. A method for building a wall or a part thereof in the ground, which comprises:

drilling at least one hole in the ground, on or parallel to the projected path of the wall or wall part, said at least one hole being drilled by a drill string;

connecting one end of said at least one drill string at the end of the drilling operation to a wall building device having cross-sectional dimensions which are substantially equal to the dimensions of at least part of the cross-section of the wall or wall part; and pulling the wall building device through the ground by retracting the at least one drill string, the wall or wall part being formed by injecting a hardenable material behind the wall building device.

2. The method of claim 1, which comprises:

providing, during the building of a first wall or wall part, said first wall or wall part with wall guiding means;

providing the wall building device or a further wall building device with wall building device guiding means for engaging the wall guiding means;

pulling the wall building device or the further wall building device guided by the first wall or wall part through the ground; and forming a second wall or wall part by injecting a hardenable material behind the wall building device or the further wall building device.

3. The method of claim 1 which comprises providing, prior to the step of injecting, at least one elongated guide member in the ground; and pulling the wall building device adapted to be guided along the at least one guide member through the ground.

4. The method of claim 1 which comprises:

connecting a leading end of at least one pulling string to the wall building device;

subsequently pulling the at least one pulling string into the ground simultaneously with pulling the wall building device through the ground, forming a first wall or wall part by injecting a hardenable material behind the wall building device during pulling of the at least one pulling string into the ground; and forming, during pulling the wall building device or a further wall building device through the ground by the at least one pulling string, a second wall or wall part by injecting a hardenable material behind the wall building device or the further wall building device.

5. The method of claim 1, which comprises:

coupling, prior to the step of injecting, at least two wall building devices to each other side by side, thereby to form an assembly of wall building devices;

pulling said assembly through the ground sideways;

thereafter pulling said assembly through the ground in a direction at an angle to said sideways direction; and forming the wall or wall part by injecting a hardenable material behind said assembly.

6. The method of claim 1, wherein the hardenable material comprises fiber concrete.

7. The method of claim 1, which comprises discharging the ground by the wall building device for creating room for the wall during pulling of the at least one drill string.

8. The method of claim 1, which comprises processing, at least during the step pulling the wall building device through the ground, at least the ground area adjacent to the front part of the wall building device according to at least one process step selected the group consisting of vibrating, lubricating, jetting and removing the ground.

9. The method of claim 1, which comprises leaving, after said material has hardened, the ground adjacent the wall substantially intact, and excavating the ground at one side of the wall.

10. The method of claim 9, wherein the step of excavating the ground comprises removing the ground using at least one device selected from the group consisting of draglines, trucks and dredging equipment.

11. A method for building a wall or a part thereof in the ground, which comprises:

drilling at least one hole in the ground, on or parallel to the projected path of the wall or wall part, each hole being drilled by a drill string;

connecting one end of each said drill string at the end of the drilling operation to one end of casing string, pulling each said casing string from the corresponding drill string, connecting one end of each casing string to a wall building device having cross-sectional dimensions vehicle are substantially equal to the dimensions of at least part of the cross-section of the wall or wall part; and pulling the wall building device through the ground by retracting each said casing string; and forming the wall or wall part by injecting a hardenable material behind the wall building device.

12. The method of claim 11, wherein during the building of a first wall or wall part, said first wall or wall part is provided with wall guiding means, the method comprising:

providing the wall building device or a further wall building device with wall building device guiding means adapted to engage the wall guiding means;

pulling the wall building device or the further wall building device guided by the first wall or wall part through the ground; and forming a second wall or wall part by injecting a hardenable material behind the wall building device or the further wall building device.

13. The method of claim 11, which comprises providing, prior to the step of injecting, at least one elongated guide member in the ground; and pulling the wall building device that is to be guided along the at least guide member through the ground.

14. The method of claim 11, which comprises:

connecting a leading end of at least one pulling string to the wall building device;

subsequently pulling the at least one pulling string into the ground simultaneously with pulling the wall building device through the ground;

forming a first wall or wall part by injecting a hardenable material behind the wall building device during pulling of the at least one pulling string into the ground; and forming, during pulling of the wall building device or a further wall building device through the ground by the at least one pulling string, a second wall or wall part by injecting a hardenable material behind the wall building device or the further wall building device.

15. The method of claim 11, which comprises:

coupling, prior to the step of injecting, at least two wall building devices to each other side-by-side, thereby to form an assembly of wall building devices;

pulling said assembly to the ground sideways; and thereafter pulling the assembly through the ground in a direction at an angle to said sideways direction, the wall or wall part being formed by injecting a hardenable material behind said assembly.

16. The method of claim 11, wherein the hardenable material comprises fiber concrete.

17. The method of claim 11, which comprises discharging the ground by the wall building device for creating room for the wall during pulling of the at least one casing string.

18. The method of claim 11, which comprises processing, at least during the step of pulling the wall building device through the ground, at least the ground area adjacent the front part of the wall building device according to at least one process step selected from the group consisting of vibrating, lubricating, jetting and removing the ground.

19. The method of claim 11, which comprises:

leaving, after the material has hardened, the ground adjacent the wall substantially intact and excavating the ground at one side of the wall.

20. A system for building a wall or a part thereof in the ground including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more holes; and wherein the pulling means comprise said one or more drill strings.

21. The system of claim 20, wherein the one or more drill strings contain at least one duct located therein for supplying the hardenable material to the wall building device.

22. The system claimed in claim 20, wherein the wall building device is adapted to build a wall or wall part provided with wall guiding means, and wherein the wall building device comprises wall building device guiding means for engaging the wall guiding means.

23. The system claimed in claim 20, comprising a first wall building device and a second wall building device, the first wall building device being adapted to build a wall or wall part provided with wall guiding means, the second wall building device comprising wall building device guiding means for engaging the wall guiding means.

24. The system of claim 20, wherein at least one guide member is provided in or on the ground, and wherein the wall building device is adapted to be guided along the at least one guide member through the ground.

25. The system claimed in claim 20, wherein the wall building device is connectable to the leading end of a pulling string for pulling of the pulling string into the ground simultaneously with pulling of the wall building device through the ground.

26. The system claimed in claim 20, wherein the wall building device has a substantially Z-shaped cross-section.

27. The system claimed in claim 20, wherein the wall building device at a position located on at least one side thereof is adapted to be coupled to another wall building device.

28. The system claimed in claim 20, which comprises a mechanism for pulling the wall building device through the ground in one of a forward direction, and a direction at an angle to the forward direction.

29. The system claimed in claim 20, wherein the wall building device includes means for processing the ground area adjacent to the front part thereof, the processing means being selected from the group of processes comprising vibrating, lubricating, jetting and removing.

30. The system claimed in claim 20, which comprises excavating means for excavating the ground at one side of the wall.

31. A system adapted for building a wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device, said wall building device including means for discharging the ground by passing the ground through the wall building device from an area adjacent the front part of the wall building device during pulling of the wall building device through the ground wherein said area is in the path of the wall to be built and has substantially the same cross-sectional dimensions as the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole; and wherein the pulling means comprise said at least one casing string.

32. The system of claim 31, further including an assembly for connecting one end of a pull string to the ends of more than one casing string, the end of the pull string being transversely spaced from the ends of the casing strings.

33. The system of claim 32, wherein said assembly comprises at least one head mounted at said end of each of said more than one casing string, said head being selected from the group of heads consisting of a drilling head, a reaming head and a jetting head.

34. The system of claim 31, wherein each casing string comprises an inner string and an outer string enclosing the inner string.

35. The system of claim 34, wherein the inner string is adapted to transfer the pulling force required by the wall building device, and the outer string is adapted to provide low friction between the inner string and the outer string when moving the inner string relative to the outer string.

36. The system of claim 35, wherein the inner string is made of steel, and the outer string is made of plastics.

37. The system of claim 36, wherein the outer string comprises polyethylene.

38. The system claimed in claim 31, wherein the at least one casing string comprises at least one duct for supplying the hardenable material to the wall building device.

39. The system of claim 31, wherein the wall building device comprises a first and second wall building device, the first wall building device being adapted to build a wall or a wall part provided with wall guiding means, the second wall building device being provided with wall building device guiding means for engaging the wall guiding means.

40. The system of claim 31, wherein at least one guide member is provided in or on the ground, and wherein the wall building device is adapted to be guided along the at least one guide member through the ground.

41. The system of claim 31, wherein the wall building device is adapted to be connected to the leading end of a pulling string for pulling of the pulling string into the ground simultaneously with pulling of the wall building device through the ground.

42. The system of claim 31, wherein the wall building device has a substantially Z-shaped cross-section.

43. The system of claim 31, wherein the wall building device is adapted at at least one side thereof to be coupled to another wall building device.

44. The system of claim 31, which comprises a mechanism for pulling the wall building device through the ground in one of a forward direction and a direction at an angle to the forward direction.

45. The system of claim 31, wherein the wall building device includes means for processing the ground area adjacent the front part thereof, the processing means being selected from the group consisting of vibrating means, lubricating means, jetting means and removing means.

46. The system claimed in claim 31, further comprising excavating means for excavating the ground at one side of the wall.

47. A combination wall and system adapted for building a wall or a part thereof in the ground, including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes;

wall material supplying means for supplying the hardenable material to the wall building device;

wherein said one or more drill strings are adapted for pulling the wall building device through the ground substantially along the path of the one or more holes; and wherein the pulling means comprise said one or more drill strings; and a duct extruded in the wall for supplying the hardenable material to the wall material supplying means.

48. A combination wall and system adapted for building a wall or a part thereof in the ground, including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more holes;

the pulling means comprise said one or more drill strings, and wherein one of a duct extruded in the wall and a duct in said one or more drill strings contains at least one line for supplying energy to the wall building device.

49. A combination wall and system adapted for building a wall or a part thereof in the ground, including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more holes;

wherein the pulling means comprise said one or more drill strings, and wherein one of a duct extruded in the wall and a duct in said one or more drill strings, contains at least one line for at least one of controlling and monitoring the wall building device.

50. A combination wall and system adapted for building a wall or a part thereof in the ground, including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more holes; and wherein the pulling means comprise said one or more drill strings, and wherein one of the wall and said one or more drill strings contain at least one duct in combination therewith for discharging ground removed by the wall building device.

51. A combination wall and system adapted for building a wall or a part thereof in the ground, including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more holes;

wherein the pulling means comprise said one or more drill strings, and wherein one of the wall and said one or more drill strings comprises at least one duct for supplying a drilling fluid to the wall building device.

52. A combination wall and system adapted for building the wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole;

wherein the pulling means comprise said at least one casing string, and wherein one of a duct extruded in the wall and a duct in the at least one casing string comprises at least one line for supplying energy to the wall building device.

53. A combination wall and system adapted for building the wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole;

wherein the pulling means comprise said at least one casing string, and wherein one of a duct extruded in the wall and said at least one casing string comprises at least one line for at least one of controlling and monitoring the wall building device.

54. A combination wall and system adapted for building the wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole;

wherein the pulling means comprise said at least one casing string, and wherein one of the wall and the at least one casing string comprises at least one duct for discharging ground removed by the wall building device.

55. A combination wall and system adapted for building the wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole;

wherein the pulling means comprise said at least one casing string, and wherein one of the wall and said at least one casing string comprises at least one duct for supplying a drilling fluid to the wall building device.

56. A combination wall and system for building the wall or a part thereof in the ground including:

drilling means for drilling one or more holes in the ground on or parallel to the projected path of the wall, the drilling means comprising one or more drill strings;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the one or more holes; and wall material supplying means for supplying the hardenable material to the wall building device;

wherein said one or more drill strings are adapted for pulling the wall building device through the ground substantially along the path of the one or more hole;

wherein the pulling means comprise the at least one drill string, the wall building device is adapted to build the wall or wall part so as to be provided with wall guiding means, the wall building device comprises wall building device guiding means for engaging the wall guiding means.

57. The combination claimed in claim 56, wherein the guide slit essentially has an L-shaped cross-section.

58. A method for building a wall or part thereof in the ground, which comprises:

pulling a wall building device through the ground with a pulling string, the wall building device having cross-sectional dimensions which are substantially equal to the dimensions of at least a part of the cross-section of the wall or wall part;

forming at least a part of the wall or wall part by injecting a hardenable material behind the wall building device; and discharging the ground by passing the ground through the wall building device from an area adjacent the front part of the wall building device, wherein said area is in the path of the wall to be built and has substantially the same cross-sectional dimensions as the wall building device.

59. A wall building device for building a wall or a part thereof in the ground, the wall building device having cross-sectional dimensions which are substantially equal to the dimensions of at least a part of the cross-section of the wall or wall part, the wall building device comprising:

injection means for injecting a harden-able material behind the wall building device;

the wall building device being adapted to be pulled through the ground, and being provided with means for discharging the ground by passing the ground through the wall building device from an area adjacent the front part of the wall building device during pulling of the wall building device through the ground, wherein said area is in the path of the wall to be built and has substantially the same cross-sectional dimensions as the wall building device.

60. The device of claim 59, wherein the means for removing the ground includes a plurality of jetting chamber.

61. The device of claim 60, wherein each jetting chamber comprises at least one rotatably driven jet tube extending substaintially parallel to a direction of movement of the wall building device.

62. A combination wall and system adapted for building the wall or a part thereof in the ground, including:

drilling means for drilling at least one hole in the ground, on or parallel to a projected path of the wall, the drilling means comprising at least one casing string;

a wall building device having cross-sectional dimensions which are substantially equal to the dimensions of at least a part of the cross-section of a wall, and having injection means for injecting a hardenable material behind the wall building device;

pulling means for pulling the wall building device through the ground substantially along the path of the at least one hole; and wall material supplying means for supplying the hardenable material to the wall building device;

wherein said at least one casing string is adapted for pulling the wall building device through the ground substantially along the path of the at least one hole;

wherein the pulling means comprise said at least one casing string, and wherein a duct is extruded in the wall for supplying the hardenable material to the wall material supply means.

63. A system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes; and a wall material supplying device for supplying the hardenable material to the wall building device;

and wherein the pulling device comprises a device for pulling said one or more drill strings through the ground substantially respectively along the path of the one or more holes, said one or more drill strings being adapted for pulling said wall building device through the ground.

64. The system of claim 63, further including an assembly for connecting one end of a pull string to the ends of more than one casing string, the end of the pull string being transversely spaced from the ends of the casing strings.

65. The system of claim 64, wherein said assembly comprises at least one head mounted at said end of each of said more than one casing string, said head being selected from the group of heads consisting of a drilling head, a reaming head and a jetting head.

66. The system of claim 63, wherein each casing string comprises an inner string and an outer string enclosing the inner string.

67. The system of claim 66, wherein the inner string is adapted to transfer the pulling force required by the wall building device, and the outer string is adapted to provide low friction between the inner string and the outer string when moving the inner string relative to the outer string.

68. The system of claim 67, wherein the inner string is made of steel, and the outer string is made of plastic.

69. The system of claim 68, wherein the outer string comprises polyethylene.

70. The system of claim 63, wherein the one or more drill strings contain at least one duct located therein for supplying the hardenable material to the wall building device.

71. The system of claim 63, where the wall building device is adapted to build a wall or a wall part provided with a wall guide, and wherein the wall building device is provided with a wall building device guiding device for engaging the wall guide.

72. The system of claim 63, wherein the wall building device comprises a first wall building device and a second wall building device, the first wall building device being adapted to build a wall or wall part provided with a wall guide, the second wall building device being provided with a wall building device guiding mechanism for engaging the wall guide.

73. The system of claim 63, wherein at least one guide member is provided in or on the ground and wherein the wall building device is adapted to be guided along the at least one guide member through the ground.

74. The system of claim 63, wherein the wall building device is adapted to be connected to the leading end of a pulling string for pulling of the pulling string into the ground simultaneously with pulling of the wall building device through the ground.

75. The system of claim 63, wherein the wall building device has a substantially Z-shaped cross-section.

76. The system of claim 63, wherein the wall building device of at least one side thereof is adapted to be coupled to another wall building device.

77. The system of claim 63, wherein the wall building device is adapted to be pulled through the ground in a forward direction and is further adapted to be pulled through the ground in a direction at an angle to the forward direction.

78. The system of claim 63, wherein the wall building device includes a device for processing the ground area adjacent to the front part thereof, the processing device being selected from the group comprising a vibrating device, a lubricating device, a jetting device and a removing device.

79. The system of claim 63, which comprises an excavating device for excavating the ground at one side of the wall.

80. A system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground.

81. A combination wall and system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes; and a wall material supplying device for supplying the hardenable material to the wall building device, wherein said one or more drill strings are adapted for pulling said wall building device through the ground substantially along the path of the one or more holes, wherein the pulling device comprises a device for pulling said one or more drill strings, and wherein a duct is extruded in the wall for supplying the hardenable material to the material supplying device.

82. A combination wall and system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes;

a wall material supplying device for supplying the hardenable material to the wall building device, wherein said one or more drill strings are adapted for pulling said wall building device through the ground substantially along the path of the one or more holes and said pulling device comprises a device for pulling said one or more drill strings, and wherein one of a duct is extruded in the wall and a duct in said one or more drill strings contains at least one line for supplying energy to the wall building device.

83. A combination wall and system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes;

a wall material supplying device for supplying the hardenable material to the wall building device, wherein said one more drill strings are adapted for pulling said wall building device through the ground substantially along the path of the one or more holes; and wherein said pulling device comprises a device for pulling said one or more drill strings; and one of a duct extruded in the wall and a duct in said one or more drill strings contains at least one line for at least one of controlling and monitoring the wall building device.

84. A combination wall and system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes;

a wall material supplying device for supplying the hardenable material to the wall building device, wherein said one or more drill strings are adapted for pulling said wall building device through the ground substantially along the path of the one or more holes and wherein said pulling device comprises a device for pulling said one or more drill strings, and wherein one of said wall and said one or more drill strings comprise at least one duct for discharging ground removed by the wall building device.

85. A combination wall and system for building a wall or a part thereof in the ground, which comprises:

a drilling device for drilling one or more holes in the ground on or parallel to the projected path of the wall, the drilling device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes;

a wall material supplying device for supplying the hardenable material to the wall building device, wherein said one or more drill strings are adapted for pulling said wall building device through the ground substantially along the path of the one or more holes, said pulling device comprises a device for pulling said one or more drill strings, and wherein one of the wall and said one or more drill strings comprise at least one duct for supplying a drilling fluid to the wall building device.

86. A combination wall and system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground, and wherein one of the wall and said at least one casing string comprises at least one duct for supplying the hardenable material to the wall building device.

87. A combination wall and system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground, and wherein one of a duct extruded in the wall and a duct in said at least one casing string contains at least one line for supplying energy to the wall building device.

88. A combination wall and system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground, and wherein one of a duct extruded in the wall and a duct in said at least one casing string comprises at least one line for at least one of controlling and monitoring the wall building device.

89. A combination wall and system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground, and wherein one of the wall and said at least one casing string comprises at least one duct for discharging ground removed by the wall building device.

90. A combination wall and system for building a wall or a part thereof in the ground, which comprises:

a drilling device for drilling at least one hole in the ground, on or parallel to a projected path of the wall, the drilling device comprising at least one drill string;

a wall building device having cross-sectional dimensions which are substantially equal to the dimensions of at least a part of the cross-section of a wall, and having a device for injecting a hardenable material behind the wall building device;

a device for discharging the ground in an area adjacent to the front part of the wall building device;

a pulling device for pulling the wall building device through the ground substantially along the path of the at least one hole; and a wall material supplying device for supplying the hardenable material to the wall building device;

wherein the pulling device comprises a device for pulling at least one casing string through the ground substantially along or parallel to the path of the at least one hole and said at least one casing string is adapted for pulling said wall building device through the ground, and wherein one of the wall and said at least one casing string comprises at least one duct for supplying a drilling fluid to the wall building device.

91. A combination wall and system for building a wall or a part thereof in the ground which comprises:

a drilling device for drilling one or more holes in the ground on or parallel to the projected path of the wall, the drawing device comprising one or more drill strings;

a wall building device having cross-sectional dimensions which are substantially equal to the dimensions of at least a part of the cross-section of a wall, and having an injection device for injecting a hardenable material behind the wall building device;

a pulling device for pulling the wall building device through the ground substantially along the path of the one or more holes; and a wall material supplying device for supplying the hardenable material to the wall building device wherein said pulling device comprises a device for pulling said one or more drill strings through the ground substantially respectively along the path of the one or more holes, said one or more drill strings being adapted for pulling said wall building device through the ground and wherein the wall building device is adapted to build a wall or a wall part provided with a wall guide, the wall building device is provided with a wall building device guiding device for engaging the wall guide and wherein the wall guide comprises a guide slit in the wall.

92. The combination wall and system of claim 91, wherein the guide slit has a substantially L-shaped cross section.

93. A combination wall and wall building device for building a wall or a part thereof in the ground, the wall building device having cross-sectional dimensions which are substantially equal to the dimensions of at least a part of the cross-section of the wall or wall part, the wall building device further comprising:

an injection device for injecting a hardenable material behind the wall building device; and the wall building device being adapted to be pulled through the ground and being provided with a device for discharging the ground by passing the ground through the wall building device from an area adjacent the front part of the wall building device during pulling of the wall building device through the ground.

94. The combination claimed in claim 93, wherein the device for removing the ground includes a plurality of jetting chambers.

95. The combination claimed in claim 94, wherein each jetting chamber comprises at least one rotatably driven jet tube extending substantially parallel to the direction of movement of the wall building device.

* * * * *

UNITED STATES PATENT AND TRADEMARK OFFICE

CERTIFICATE OF CORRECTION

PATENT NO. : 6,357,965 B2
DATED : March 19, 2002
INVENTOR(S) : Lammertink et al.

It is certified that error appears in the above-identified patent and that said Letters Patent is hereby corrected as shown below:

Title page,
Item [73], Assignee, should read:
-- [73] Assignee: Heerema Holding Construction Inc., Geneva (CH) --

Signed and Sealed this

Twenty-seventh Day of May, 2003

JAMES E. ROGAN
*Director of the United States Patent and Trademark Office*